US010887712B2

(12) United States Patent
Berthelsen et al.

(10) Patent No.: US 10,887,712 B2
(45) Date of Patent: Jan. 5, 2021

(54) POST LINEARIZATION SYSTEM AND METHOD USING TRACKING SIGNAL

(71) Applicant: KNOWLES ELECTRONICS, LLC, Itasca, IL (US)

(72) Inventors: Kim Spetzler Berthelsen, Koego (DK); Michael Kuntzman, Chicago, IL (US); Claus Furst, Himmelev (DK); Sung Bok Lee, Chicago, IL (US); Mohammad Shajaan, Vaerlose (DK); Venkataraman Chandrasekaran, Itasca, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/626,596

(22) PCT Filed: Jun. 26, 2018

(86) PCT No.: PCT/US2018/039617
§ 371 (c)(1),
(2) Date: Dec. 26, 2019

(87) PCT Pub. No.: WO2019/005885
PCT Pub. Date: Jan. 3, 2019

(65) Prior Publication Data

US 2020/0162830 A1 May 21, 2020

Related U.S. Application Data

(60) Provisional application No. 62/525,640, filed on Jun. 27, 2017.

(51) Int. Cl.
*H04R 29/00* (2006.01)
*H04R 1/04* (2006.01)
(Continued)

(52) U.S. Cl.
CPC ..... *H04R 29/004* (2013.01); *H04R 1/04* (2013.01); *H04R 3/04* (2013.01); *H04R 19/005* (2013.01);
(Continued)

(58) Field of Classification Search
CPC ... H04R 1/04; H04R 3/00; H04R 3/04; H04R 19/005; H04R 19/04; H04R 19/016;
(Continued)

(56) References Cited

U.S. PATENT DOCUMENTS 7,190,038 B2 3/2007 Dehe et al.
7,473,572 B2 1/2009 Dehe et al.
(Continued)

OTHER PUBLICATIONS

Gao, Zheng, and Ping Gui. "A look-up-table digital predistortion technique for high-voltage power amplifiers in ultrasonic applications." IEEE transactions on ultrasonics, ferroelectrics, and frequency control 59.7 (2012).
(Continued)

*Primary Examiner* — Xu Mei
(74) *Attorney, Agent, or Firm* — Foley & Lardner LLP

(57) ABSTRACT

A microphone assembly includes an acoustic transducer and an audio signal electrical circuit configured to receive an output signal from the acoustic transducer. The output signal includes an audio signal component and a tracking signal component. The audio signal component is representative of an acoustic signal detected by the acoustic transducer and the tracking signal component is based on an input tracking signal applied to the acoustic transducer. The audio signal electrical circuit includes an analog to digital converter configured to convert the output signal into a digital signal, an extraction circuit configured to separate the tracking signal component and the audio signal component from the digital signal, an envelope estimation circuit configured to estimate a tracking signal envelope from the tracking signal
(Continued)

component, and a signal correction circuit configured to reduce distortion in the audio signal component using the tracking signal envelope.

20 Claims, 15 Drawing Sheets

(51) Int. Cl.
*H04R 3/04* (2006.01)
*H04R 19/00* (2006.01)
*H04R 19/04* (2006.01)

(52) U.S. Cl.
CPC ..... *H04R 19/04* (2013.01); *H04R 2201/003* (2013.01); *H04R 2410/03* (2013.01)

(58) Field of Classification Search
CPC ..... H04R 2201/003; H04R 2410/03; H03G 7/00; H03G 11/00
USPC ..... 381/56, 94.1, 94.8, 94.9, 91, 122, 381/111–115, 106; 333/14; 455/72
See application file for complete search history.

(56) References Cited

U.S. PATENT DOCUMENTS 7,781,249 B2 8/2010 Laming et al.
7,795,695 B2 9/2010 Weigold et al.
7,825,484 B2 11/2010 Martin et al.
7,829,961 B2 11/2010 Hsiao
7,856,804 B2 12/2010 Laming et al.
7,903,831 B2 3/2011 Song
8,085,941 B2 * 12/2011 Taenzer ..... H03G 3/32 381/57
10,158,337 B2 * 12/2018 Bongiovi ..... H04S 7/307
2004/0228494 A1 11/2004 Smith
2005/0207605 A1 9/2005 Dehe et al.
2006/0089958 A1 4/2006 Giesbrecht et al.
2007/0055505 A1 3/2007 Doclo et al.
2007/0278501 A1 12/2007 MacPherson et al.
2008/0175425 A1 7/2008 Roberts et al.
2008/0267431 A1 10/2008 Leidl et al.
2008/0279407 A1 11/2008 Pahl
2008/0283942 A1 11/2008 Huang et al.
2009/0001553 A1 1/2009 Pahl et al.
2009/0180655 A1 7/2009 Tien et al.
2010/0046780 A1 2/2010 Song
2010/0052082 A1 3/2010 Lee et al.
2010/0128914 A1 5/2010 Khenkin
2010/0183181 A1 7/2010 Wang
2010/0246877 A1 9/2010 Wang et al.
2010/0290644 A1 11/2010 Wu et al.
2010/0322443 A1 12/2010 Wu et al.
2010/0322451 A1 12/2010 Wu et al.
2011/0013787 A1 1/2011 Chang
2011/0075875 A1 3/2011 Wu et al.
2015/0071463 A1 * 3/2015 Niemisto ..... G10L 21/0224 381/94.5
2015/0117685 A1 * 4/2015 Reiss ..... H04R 3/00 381/300
2015/0271616 A1 9/2015 Kechichian
2016/0157017 A1 6/2016 Lesso et al.
2018/0160235 A1 * 6/2018 Lesso ..... G01S 15/10

OTHER PUBLICATIONS

International Search Report and Written Opinion, PCT/US2018/039617, Knowles Electronics, LLC, 9 pages (Sep. 7, 2018).
Patel, Jayanti. "Adaptive digital predistortion linearizer for power amplifiers in military UHF satellite." (2004).

* cited by examiner

FIG. 13A
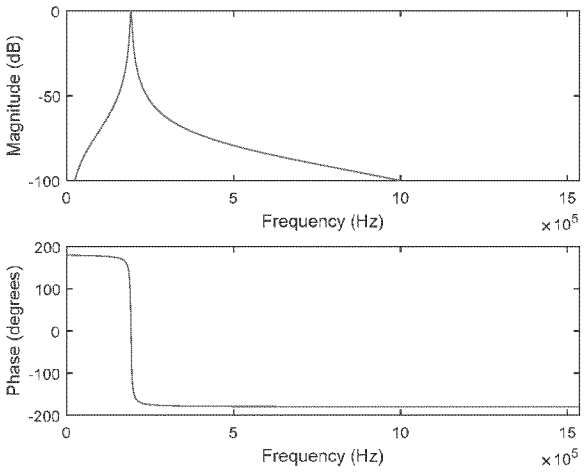
FIG. 13B
FIG. 12A
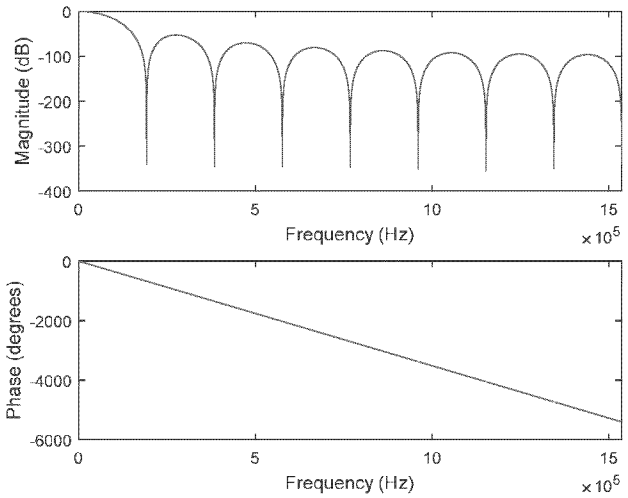
FIG. 12B

POST LINEARIZATION SYSTEM AND METHOD USING TRACKING SIGNAL

CROSS-REFERENCE TO RELATED APPLICATIONS

This application is a National Stage Application of PCT/US2018/039617, filed Jun. 26, 2018, which claims the benefit of and priority to U.S. Provisional Patent Application No. 62/525,640, filed Jun. 27, 2017, the entire contents of which are incorporated herein by reference

BACKGROUND

Microphones are widely used in a variety of applications, such as in smartphones, mobile phones, tablets, headsets, hearing aids, sensors, automobiles, etc. It is desirable to increase sound quality in such microphones. Present day microphones have limitations due to their configuration and the way they operate.

BRIEF DESCRIPTION OF THE DRAWINGS

FIGS. 12A-12B are graphs illustrating frequency and phase responses of a low pass filter used in the schematics of FIGS. 9-11.

FIGS. 13A-13B are graphs illustrating frequency and phase responses of a peak filter used in the schematic of FIG. 9.

DETAILED DESCRIPTION

Figure 1:
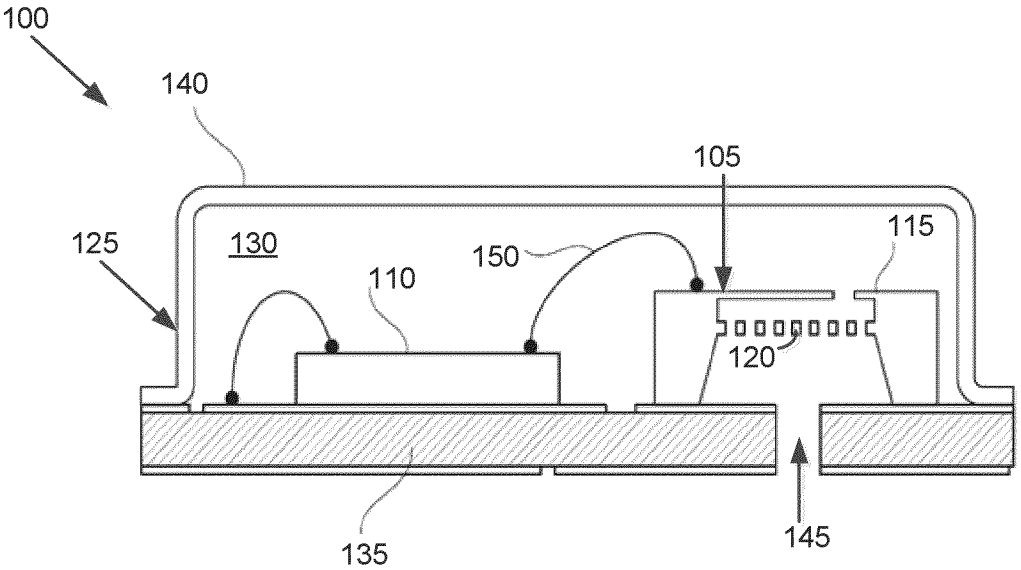
FIG. 1 is a schematic of a microphone assembly.

The present disclosure relates generally to a system and method for compensating for distortion in an output of a microphone assembly including an acoustic transducer and a processing circuit. Generally, distortion in the output of the microphone assembly is attributable at least in part to non-linearity in the acoustic transducer and the processing circuit. In condenser type MEMS microphones, the non-linearity may be due to the bending of a diaphragm, especially at higher sound pressure levels, and asymmetry in the deflection of the diaphragm among other factors. The non-linearity in the processing circuit may be due to receiving and processing an analog output signal from the acoustic transducer and/or charge sharing between the acoustic transducer and the processing circuit, among other factors. Non-linearity in other types of MEMS microphones (e.g., piezoelectric or optical transducers) may result from other sources.

As the sound pressure levels increase, the non-linearity of acoustic transducers tends to increase, which in turn increases distortion in the output of the microphone assembly. Distortion may include harmonic components, intermodulation components, or other distortion components. These distortion components impact the sound quality and are therefore undesirable. Distortion may be expressed as a percentage of deviation in the output of the microphone assembly relative to an acoustic input signal applied to the acoustic transducer.

The present disclosure provides systems and methods to identify the distortion in the output of the microphone assembly and compensate for that distortion. The distortion is determined using a known input tracking signal. In implementations that require a bias voltage, the input tracking signal is input to the acoustic transducer via the bias voltage. In condenser type acoustic transducers, for example, the bias voltage is applied by a charge pump and thus the input tracking signal may be combined with the charge pump signal. Other types of acoustic transducers may have other bias voltage sources through which the input tracking signal may be applied to the acoustic transducer. In other embodiments, the input tracking signal is input to the acoustic transducer as an acoustic signal. The output signal of the acoustic transducer includes a tracking signal component based on the input tracking signal and an audio signal component representative of the acoustic input signal applied to the acoustic transducer. The audio signal component may be distorted, particularly at higher sound pressure levels, as discussed above.

By looking at the changes in the tracking signal component, the distortion in the audio signal component may be identified and compensated. Specifically, the input tracking signal is a static signal, the frequency and amplitude of which is known. The non-linearity of the acoustic transducer and processing circuits causes distortion in the input tracking signal as well. The distortion in the input tracking signal may be used to detect and compensate for distortion in the audio signal component.

FIG. 1 is a microphone assembly 100 having a micro-electromechanical systems (MEMS) acoustic sensor 105 and a processing circuit 110. The microphone assembly 100 converts acoustic input signals (e.g., changes in air pressure) into electrical signals. The MEMS acoustic sensor 105 may be implemented as a capacitive or condenser sensor, or a piezoelectric sensor, or an optical sensor. In FIG. 1, the acoustic sensor 105 is a capacitive sensor having a back plate 115 and a diaphragm 120. The microphone assembly 100 also includes a housing 125 defining an enclosed volume 130. The housing 125 includes a base 135 and a cover 140 fastened thereto that encloses and protects the acoustic sensor 105 and the processing circuit 110 disposed therein. An acoustic port 145 in the housing 125 permits the acoustic sensor 105 to sense changes in air pressure outside the housing. The base 135 may be embodied as a layered material like FR4 with embedded conductors forming a PCB. The cover 140 may be embodied as a metal can, or a layered FR4 material, which may also include embedded conductors. The cover 140 may also be formed from other materials like plastics and ceramics, and the housing generally may include electromagnetic shielding.

In some embodiments, the housing 125 includes external contacts on a surface thereof forming an external device interface, also called a physical interface, for integration with a host device in a reflow or wave soldering operation. In some embodiments, the external device interface includes power, ground, clock, data, and select contacts. The particular contacts constituting the external device interface, however, depend on the protocol with which data is communicated between the microphone assembly 100 and the host device. Such protocols include, but are not limited to, PDM, SoundWire, I2S, and I2C among others.

The processing circuit 110 (also referred to herein as an electrical circuit, an audio signal processing circuit, or audio signal electrical circuit) is configured to receive an electrical signal (also referred to herein as a transducer output signal or an output signal) from the acoustic sensor 105. The acoustic sensor 105 may be operationally connected to the processing circuit 110 using one or more bond wires 150. In other embodiments, other connecting mechanisms such as, vias, traces, electrical connectors, etc. may be used to electronically connect the acoustic sensor 105 to the processing circuit 110. After processing the electrical signal from the acoustic sensor 105, the processing circuit 110 provides the processed electrical signal or microphone signal at an output or interface of the microphone assembly for use by a computing or host device (e.g., a smartphone).

Only certain components of the microphone assembly 100 are discussed herein. Other components, such as motors, charge pumps, power sources, filters, resistors, etc. that may be used to implement functions described herein and/or other functions of the discussed devices, are not discussed in detail but are contemplated and considered within the scope of the present disclosure.

Additionally, several variations in the microphone assembly 100 are contemplated. For example, although the processing circuit 110 and the acoustic sensor 105 are shown as separate components, in some embodiments, the processing circuit and the acoustic sensor may be integrated together into a single component. In some embodiments, either or both the acoustic sensor 105 and the processing circuit 110 may be constructed from a semiconductor die using, for example, mixed-signal complementary metal-oxide semiconductor devices. In other embodiments, other techniques may be used to construct the acoustic sensor 105 and the processing circuit 110. In some embodiments, the processing circuit 110 may be configured as an application specific integrated circuit (ASIC).

Figure 2:
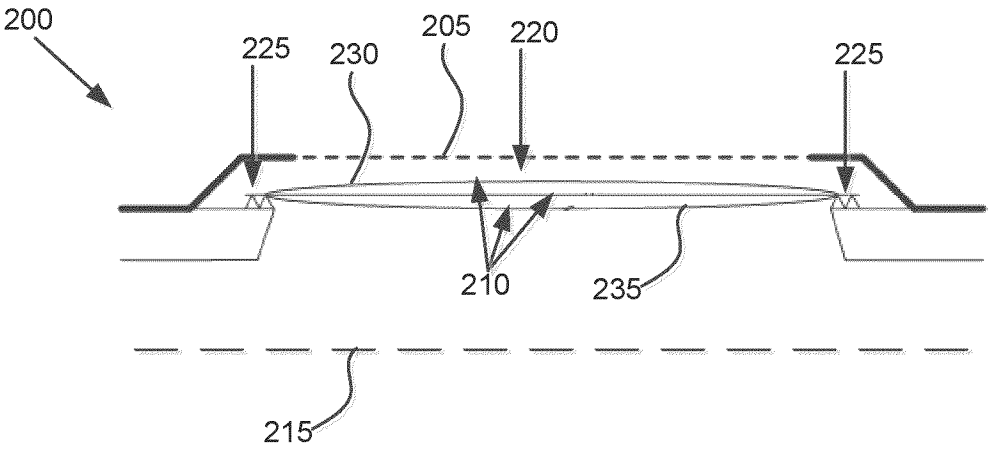
FIG. 2 is a schematic showing impact on a diaphragm of an acoustic transducer of the microphone assembly of FIG. 1 at varying sound pressure levels.

In FIG. 2, an acoustic transducer 200 includes a back plate 205, a diaphragm 210, and an acoustic port 215. The acoustic transducer 200 is similar to the acoustic sensor 105 of FIG. 1 above. In response to variances in sound pressure levels ("SPLs") at the acoustic port 215, the diaphragm 210 bends relative to the back plate 205. This bending of the diaphragm 210 may distort the output signal of the acoustic transducer 200, particularly at higher sound pressure levels. For relatively small deflections, the distance between the diaphragm 210 and the back plate 205 is substantially equal at both a center location 220 and at edge locations 225 and, therefore, the output signal of the acoustic transducer 200 is substantially an accurate reproduction of the acoustic input signal.

At higher SPL, however, the diaphragm 210 deflects more, as shown in exaggerated positions 230 and 235. In the positions 230 or 235, the distance between the back plate 205 and the diaphragm 210 at the center location 220 is unequal relative to the distance between the back plate and the diaphragm at the edge locations 225. The asymmetric deflection of the diaphragm 210 toward and away from the back plate 205, among other reasons, produces distortion in the output signal. Additional distortion may be introduced by the processing circuit. Thus, the microphone signal that is output from the microphone assembly having the acoustic transducer 200 is not a substantially accurate reproduction of the acoustic input signal.

Figure 3:
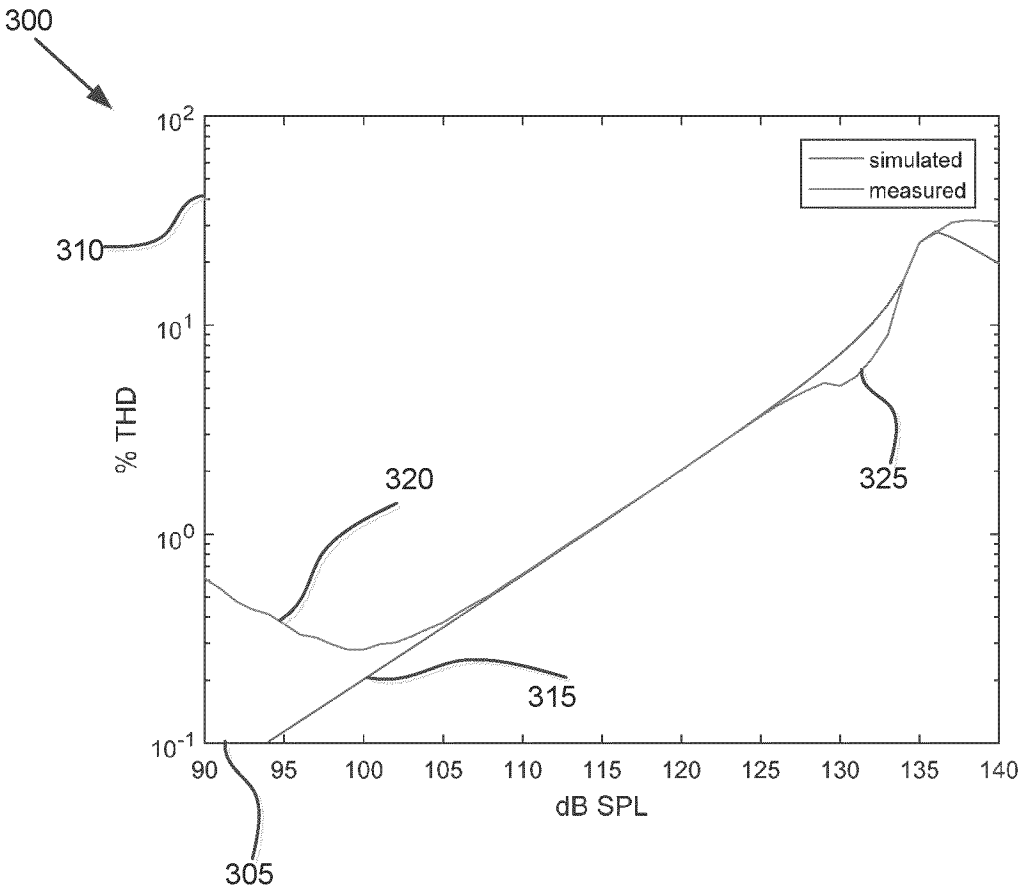
FIG. 3 is a graph illustrating distortion in an output signal of the acoustic transducer of FIG. 2 at high sound pressure levels.

In FIG. 3, a graph 300 plots SPL in decibels on x-axis 305 against total harmonic distortion in percentage on y-axis 310 to show differences between a simulated output signal and a measured output signal. Specifically, the graph 300 shows a first plot 315 of a simulated output signal and a second plot 320 of a measured output signal of a MEMS acoustic transducer. Similar plots could be produced for the output of the microphone assembly (i.e., the output of the acoustic transducer and the processing circuit). The first plot 315 is representative of an acoustic transducer that is substantially linear at both low SPL (e.g., less than 125-130 dB SPL) and high SPL (e.g., greater than 125-130 dB SPL). The second plot 320 is illustrative of an acoustic transducer that is non-linear, as shown by region 325, at high SPL. Thus, in an ideal case, the acoustic transducer is linear even at high SPL, but in practice, as the SPL increases, the acoustic transducer becomes non-linear.

Figure 4A:
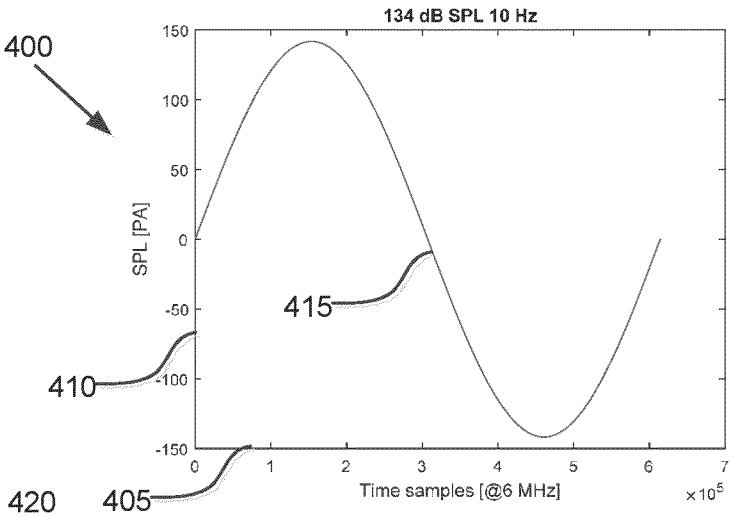
FIG. 4A is a graph illustrating an acoustic input signal that is input into the acoustic transducer of FIG. 2.
Figure 4B:
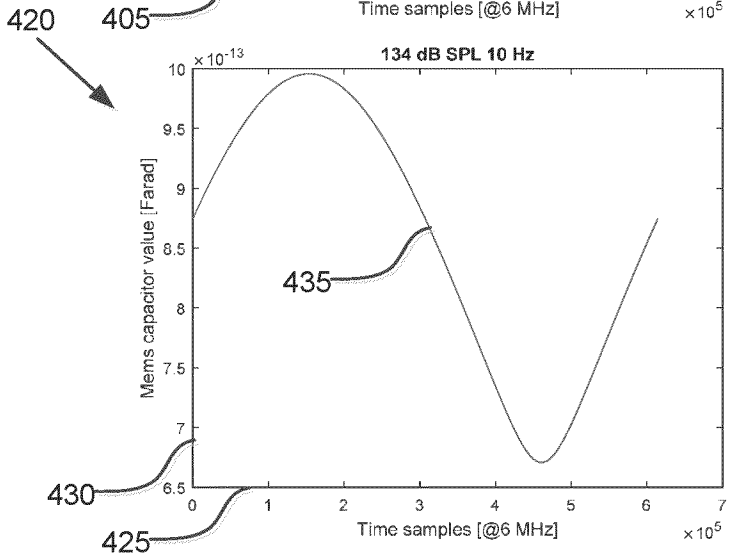
FIG. 4B is a graph illustrating variation in capacitance of the acoustic transducer of FIG. 2 due to the acoustic input signal of FIG. 4A.

FIG. 4A shows a graph 400 that plots time samples on x-axis 405 against SPL on y-axis 410. The graph 400 shows an input plot 415 representative of an acoustic input signal applied to or detected by the acoustic transducer (e.g., the acoustic transducer 200 in FIG. 2) at a high SPL value of one hundred and thirty four decibels (134 dB) SPL at a frequency of ten hertz (10 Hz). FIG. 4B shows a graph 420 that plots time samples on x-axis 425 against capacitance measured between the diaphragm and the back plate (e.g., the diaphragm 210 and the back plate 205 in FIG. 2) by the acoustic transducer on y-axis 430. The graph 420 shows an output plot 435 representative of an output signal from the acoustic transducer and particularly, a change in capacitance in the output signal relative to the acoustic input signal represented by the input plot 415 of FIG. 4A. By comparing the graph 400 with the graph 420, it can be seen that the output signal does not track the acoustic input signal (i.e., the output signal is distorted relative to the acoustic input signal). The variance in the output signal relative to the acoustic input signal arises due to the non-linearity in the acoustic transducer. A plot similar to FIG. 4B could be made for the microphone signal output by the microphone assembly where the distortion results from non-linearity in both the acoustic transducer and the processing circuit. By identifying and compensating for the non-linearity, the output signal of the acoustic transducer and/or the microphone signal of the microphone assembly may be made to substantially replicate the input plot 415 representative of the acoustic input signal, thereby reducing distortion and improving sound quality.

In some embodiments, the distortion in the output signal and/or the microphone signal may be tracked or determined using an input tracking signal. Specifically, when the input tracking signal is input into an acoustic transducer (e.g., the acoustic transducer 200), the output signal from the acoustic transducer includes an audio signal component and a tracking signal component. As the output signal is processed by a processing circuit (e.g., the processing circuit 110) of the microphone assembly (e.g., the microphone assembly 100), the output signal may become further distorted by non-linearity introduced by the processing circuit. The distortion introduced by the acoustic transducer and the processing circuit is reflected in the audio signal component of the microphone signal. The tracking signal component is subject to the same (or substantially same) distortion as the audio signal component. By tracking the changes in the tracking signal component relative to the known input tracking signal, the distortion in the audio signal component may be identified and compensated.

Figure 5:
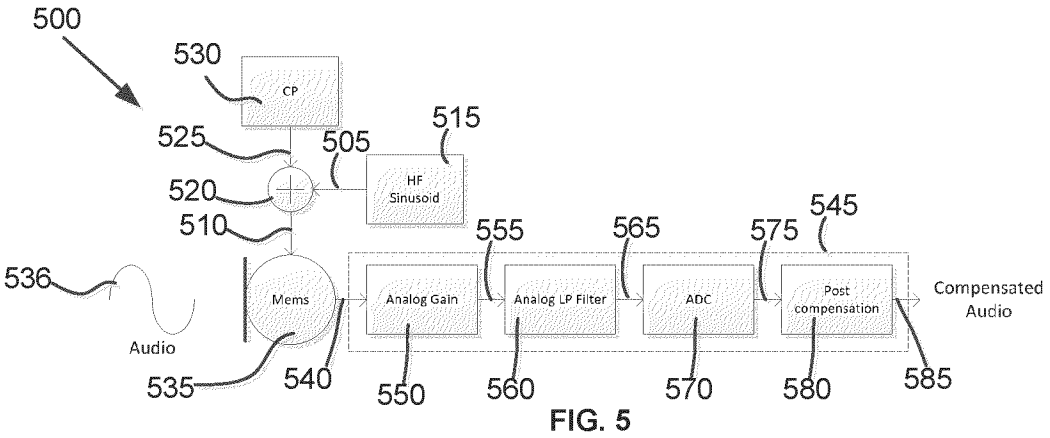
FIG. 5 is a first schematic showing a system for applying an input tracking signal to an acoustic transducer.

FIG. 5 is a schematic illustration of a microphone assembly 500 showing introduction of an input tracking signal 505 via an input signal 510 into an acoustic transducer 535. The input tracking signal 505 is a known signal that is generated by a tracking signal generator 515. The tracking signal generator 515 may be a wave generator or another device that is capable of generating sinusoidal, square wave, or other known signal. In some embodiments, the input tracking signal 505 is a high frequency signal with frequencies greater than the normal audio band and, possibly greater than ultrasonic signals. Additionally, the input tracking signal 505 is generated at a sound pressure level that lies or substantially lies within a linear range of the microphone assembly 500.

For example, in some embodiments, the input tracking signal 505 may be a forty-eight kilohertz (48 kHz) signal, ninety-six (96) kHz signal, one hundred ninety-two (192) kHz signal, or a three hundred eighty-four (384) kHz signal. In other embodiments, other frequencies may be used for the input tracking signal 505. Likewise, in some embodiments, the input tracking signal 505 may be between twenty and one hundred SPL (20-100 dB SPL) and, in some implementations, between one hundred forty and one hundred sixty decibel SPL (140-160 dB SPL). In other embodiments, other SPL signals may be used for the input tracking signal 505 depending upon the capabilities of the microphone assembly 500. Additionally, the input tracking signal 505 is a static signal, the frequency and SPL level of which is not generally varied. However, when an input acoustic signal into the microphone assembly 500 is at a low SPL, the input tracking signal 505 may be disabled or the SPL/frequency of the input tracking signal may be adjusted.

The input tracking signal 505 is combined, in a combination circuit 520, with a charge pump signal 525 generated by a charge pump 530 to produce the input signal 510. In some embodiments, the combination circuit 520 is a summation circuit that sums up the charge pump signal 525 with the input tracking signal 505. Combination of the charge pump signal 525 and the input tracking signal 505 are input into the acoustic transducer 535 of the microphone assembly 500. The input tracking signal 505 is modulated by an electrical signal produced upon transduction of an acoustic input signal 536 applied to the acoustic transducer 535. In response to the acoustic input signal 536, the acoustic transducer 535 outputs an output signal 540, which includes an audio signal component representative of the acoustic input signal 536 and a tracking signal component based on the input tracking signal 505.

The processing circuit 545 includes an amplifier 550 configured to amplify the output signal 540 into an amplified signal 555. Although not shown, the amplifier 550 may be a single ended amplifier or a differential amplifier. Further, the amplifier 550 may be configured with a specified gain, or in other words, an amplifying ability that may be expressed as a ratio of the output of the amplifier to the input of the amplifier. Also, although only a single amplifier is shown, in some embodiments, multiple amplifiers connected in series or having other topologies may be used. Likewise, in some embodiments, the amplifier 550 may use multiple gain stages, filters, or other components that may be deemed necessary or desirable in obtaining the amplified signal to perform the functions described herein.

The amplified signal 555 is then input into a low pass filter 560. The low pass filter 560, which is analog in nature, may be configured to pass signals below a specific cutoff frequency, and to attenuate signals above that cutoff frequency. In some embodiments, the cutoff frequency may be set to around six hundred kilo hertz (~600 kHz). By virtue of using the low pass filter 560, aliasing in the amplified signal 555 may be avoided. Filtered signal 565 from the low pass filter 560 is input into an analog to digital converter ("ADC") 570.

The ADC 570 is configured to receive, sample, and quantize the filtered signal 565 and generate a corresponding digital signal 575, which is then input into a post compensation circuit 580. Thus, the ADC 570 receives an analog signal (e.g., the filtered signal 565) and converts that analog signal into a digital signal (e.g., the digital signal 575). The digital signal 575 also includes the audio signal component and the tracking signal component described above, albeit in digital form.

The ADC 570 may also be configured in a variety of ways. In some embodiments, the ADC 570 may be adapted to output the digital signal in a multibit format. In other embodiments, the ADC 570 may be configured to generate the digital signal 575 in a single bit format. In some embodiments, the ADC 570 may be based on a sigma-delta converter (IA), while in other embodiments, the ADC may be based on any other type of a converter, such as a flash ADC, a data-encoded ADC, a Wilkinson ADC, a pipeline ADC, etc. The ADC 570 may be also be configured to generate the digital signal 575 at a specific sampling frequency or sampling rate.

The digital signal 575 is input into the post compensation circuit 580, which identifies and compensates for the distortion in the audio signal component of the digital signal to obtain a compensated microphone signal 585. Although not shown, in some embodiments, the compensated microphone signal 585 may be transmitted as input to other components (e.g., an interpolator, a digital-to-digital converter, etc.) for further processing by a digital signal processing circuit of the microphone assembly or by a processor of a host device (e.g., smartphone). The post compensation circuit 580 is described in greater detail in FIGS. 9-11 below.

Figure 6:
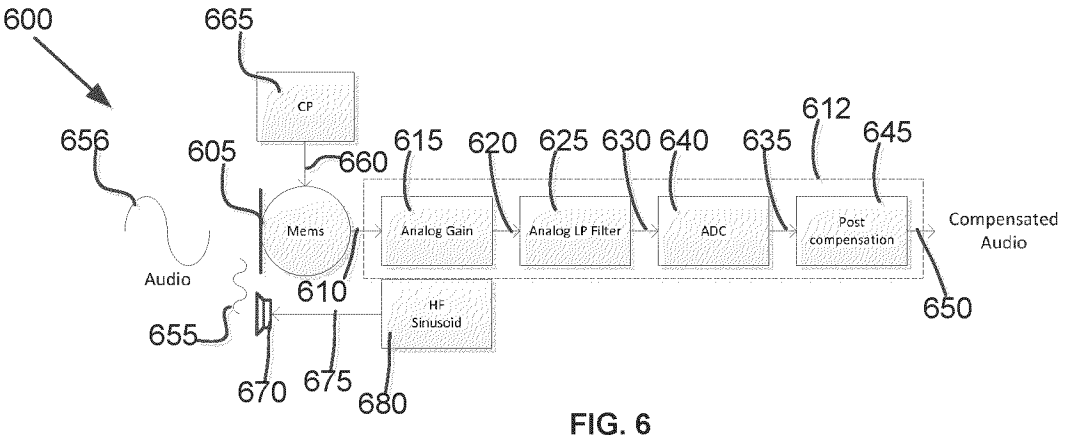
FIG. 6 is a second schematic showing another system for applying the input tracking signal to the acoustic transducer.

FIG. 6 is another embodiment of a microphone assembly 600. The microphone assembly 600 is similar in some respects to the microphone assembly 500 in FIG. 5. Specifically, the microphone assembly 600 includes an acoustic transducer 605 that generates an output signal 610, which is input into a processing circuit 612. The processing circuit 612 includes an amplifier 615 to generate an amplified signal 620, which is filtered using an analog low pass filter 625 to generate a filtered signal 630. The filtered signal 630 is converted into a digital signal 635 using ADC 640. The digital signal 635 is then adjusted in a post compensation circuit 645 to compensate for distortion in an audio signal component of the digital signal 635 to generate a compensated microphone signal 650. The post compensation circuit 645 is also described in greater detail in FIGS. 9-11 below.

In FIG. 6, bias voltage via charge pump signal 660 is applied via charge pump 665. Input tracking signal 655 is an acoustic signal input to the acoustic transducer 605 with acoustic input signal 656. The input tracking signal 655 is generated by an acoustic transducer 670 situated adjacent the acoustic transducer 605. The acoustic transducer 670 may receive an input signal 675 from a tracking signal generator 680. The tracking signal generator 680 in FIG. 6 may be similar to the tracking signal generator 515 in FIG. 5.

Figure 7:
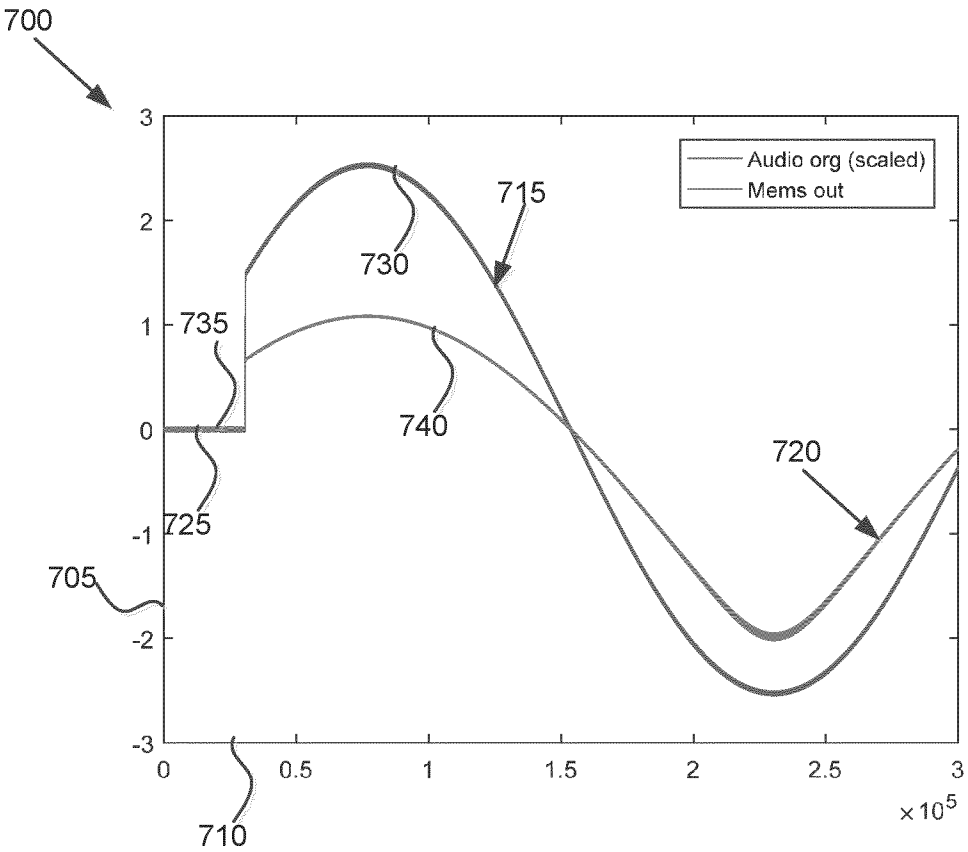
FIG. 7 is a graph illustrating an input signal into the acoustic transducer of FIG. 2 and the corresponding output signal from the acoustic transducer.

FIG. 7 is a graph 700 that plots voltage in volts on y-axis 705 against number of samples per second on x-axis 710. The graph 700 shows an input plot 715 and an output plot 720. It is to be understood that the input plot 715 and the output plot 720 have been exaggerated for the purpose of illustrating the various components of those plots. The input plot 715 includes an input tracking signal portion 725 (representative of the input tracking signal 505) and an acoustic input signal portion 730 (e.g., representative of the acoustic input signal 656). In some embodiments, the acoustic input signal portion 730 may be representative of a signal that is a ten hertz (10 Hz) high SPL signal. The input tracking signal portion 725 is applied to the acoustic transducer (e.g., the acoustic transducer 535) when no audio signal (e.g., the acoustic input signal) is used. To apply the input tracking signal portion 725, the acoustic transducer may be placed within a sound box to isolate the acoustic transducer from the acoustic input signal. Alternatively, in some embodiments, the input tracking signal portion 725 may be applied to the acoustic transducer during a low SPL operation when the acoustic transducer is generally operating in a linear region. The application of the input tacking signal portion 725 may be performed during a start-up of the microphone assembly and/or during production.

After the application of the input tracking signal in the input tracking signal portion 725, the acoustic transducer may be subject to the acoustic input signal 656 to obtain the acoustic input signal portion 730. The acoustic input signal portion 730 is solely an acoustic signal without having any component of the input tracking signal. Thus, the input plot 715 includes the input tracking signal portion 725 representative of the input tracking signal 505 and the acoustic input signal portion 730 representative of the acoustic input signal 656.

In response to the signal of the input plot 715, the acoustic transducer outputs an output signal, which is represented by the output plot 720. Like the input plot 715, the output plot 720 includes an output tracking signal portion 735 and an output audio signal portion 740. The output tracking signal portion 735 corresponds to the input tracking signal portion 725 when no acoustic input signal has been applied. The output audio signal portion 740 is obtained in response to the input tracking signal portion 725 and includes a tracking signal component and an audio signal component. The tracking signal component is the output representative of the input tracking signal 505 applied at the input of the acoustic transducer and the audio signal component is the output representative of the acoustic input signal 656 applied at the input of the acoustic transducer.

Due to distortion, the output plot 720 does not accurately track (i.e., follow the shape of) the input plot 715. As also seen from FIG. 7, while the input plot 715 is a symmetric plot, the output plot 720 is asymmetric (i.e., does not follow the shape of the input plot) due to distortion.

Figure 8:
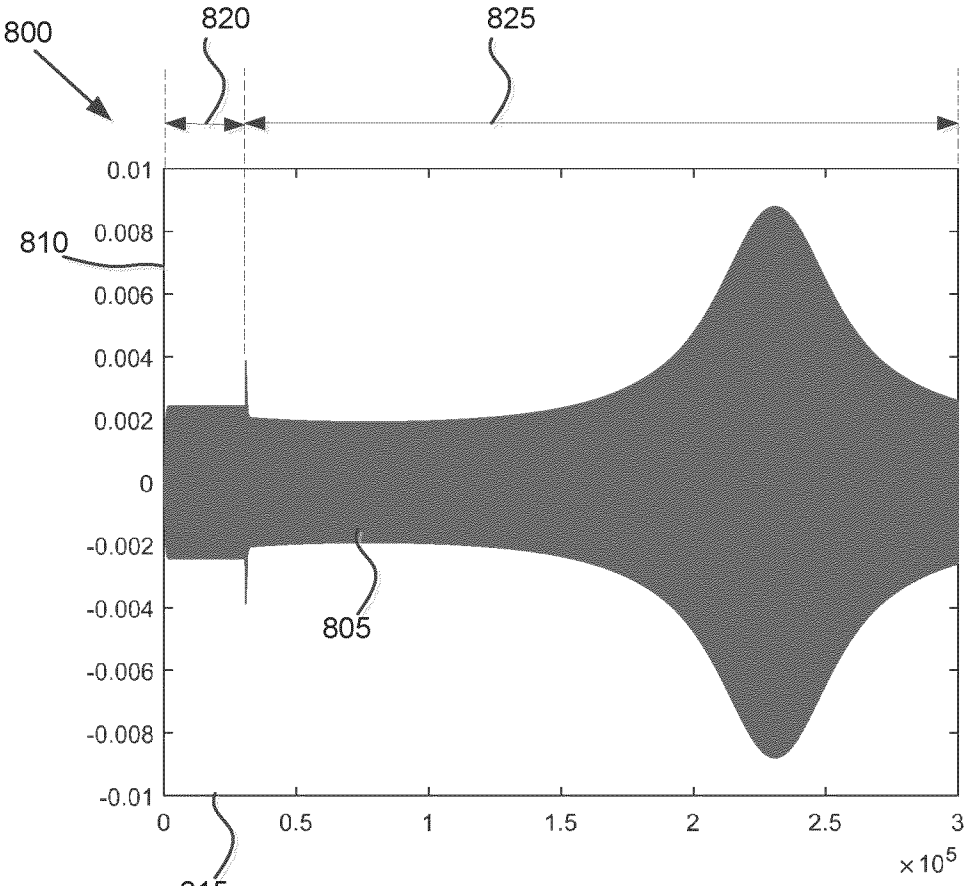
FIG. 8 is a graph illustrating a tracking signal component.

FIG. 8 is a graph 800 showing a tracking signal component 805 in greater detail. The tracking signal component 805 is an exaggerated illustration. The graph 800 plots a calibration value of the tracking signal component 805 on y-axis 810 against a number of samples per second on x-axis 815. Calibration value refers to an amplitude of the tracking signal component 805. The tracking signal component 805 includes a first portion 820 that corresponds to the output tracking signal portion 735 and a second portion 825 that corresponds to the tracking signal component in the output audio signal portion 740 of FIG. 7 above. The second portion 825 shows how the first portion 820 changes at the output of the acoustic transducer as a result of the acoustic input signal 656. The calibration value on the y-axis 810 corresponding to the first portion 820 is identified and stored for obtaining a normalized envelope of the second portion 825, as explained below. The normalized envelope is then used to compensate for the distortion in the audio signal component of the output audio signal portion 740.

Figure 9:
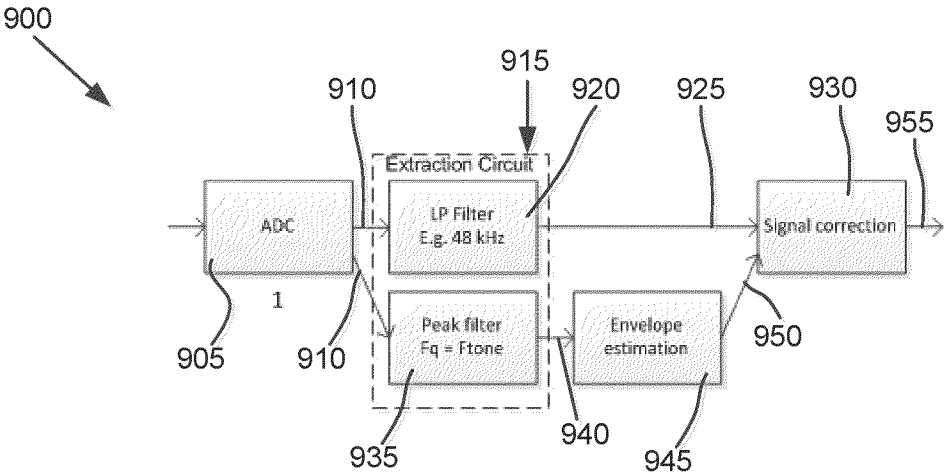
FIG. 9 is a first schematic showing separation of an audio signal component and the tracking signal component, estimation of the tracking signal envelope, and compensation of distortion in the audio signal component.

Distortion may be compensated in a post compensation circuit. FIG. 9 is an example of one such post compensation circuit 900. Although the ADC 905 is shown as being part of the post compensation circuit 900, in some embodiments, the ADC 905 is located outside of the post compensation circuit, such as shown in FIGS. 5 and 6 above.

The ADC 905 generates a digital signal 910. The digital signal 910 includes an audio signal component and a tracking signal component. The digital signal 910 is input into an extraction circuit 915. The extraction circuit 915 separates the audio signal component from the tracking signal component. Specifically, the extraction circuit 915 includes a low pass filter 920, which receives the digital signal 910 and extracts the audio signal component from the digital signal to obtain a filtered audio signal component 925, which is input into a signal correction circuit 930.

More specifically, the low pass filter 920, which extracts the audio signal component, is configured with a cutoff frequency to allow the low pass filter to pass through signals below the cutoff frequency and cut off signals above the cutoff frequency. Thus, the low pass filter 920 may be set with a cutoff frequency that allows the audio signal component to pass through while blocking the tracking signal component. In some embodiments, the low pass filter 920 may be configured with a cutoff frequency of about forty-eight (48) kHz. In other embodiments, other cutoff frequencies may be used in the low pass filter 920 depending upon the frequency of the tracking signal component that is to be filtered out. Further, in some embodiments, the low pass filter 920 may be configured as a Sinc filter with a first notch placed at a frequency of the input tracking signal (e.g., the input tracking signal 505, 655) from which the digital signal 910 is obtained. In other embodiments, a cascaded integrator-comb (CIC) filter or any other low pass filter that is suitable to separate the audio signal component from the tracking signal component may be used. An example configuration of the low pass filter 920 is shown in FIGS. 12A and 12B.

In addition to inputting the digital signal 910 into the low pass filter 920, the digital signal is also input into a peak filter 935 of the extraction circuit 915. The peak filter 935 is configured to extract the tracking signal component from the digital signal 910. In some embodiments, the peak filter 935 may be configured with a center frequency that corresponds to the frequency of the tracking signal component. An example configuration of the peak filter 935 is shown in FIGS. 13A and 13B. The peak filter 935 generates a filtered tracking signal component 940, which is then input into an envelope estimation circuit 945.

Figure 14:
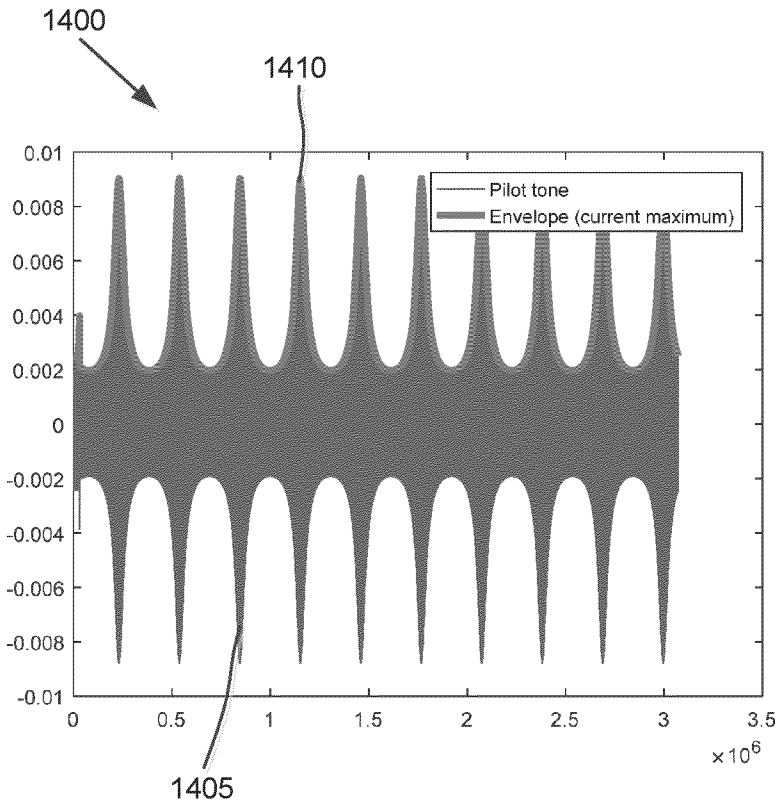
FIG. 14 is a graph illustrating an estimated envelope of the tracking signal component.
Figure 15:
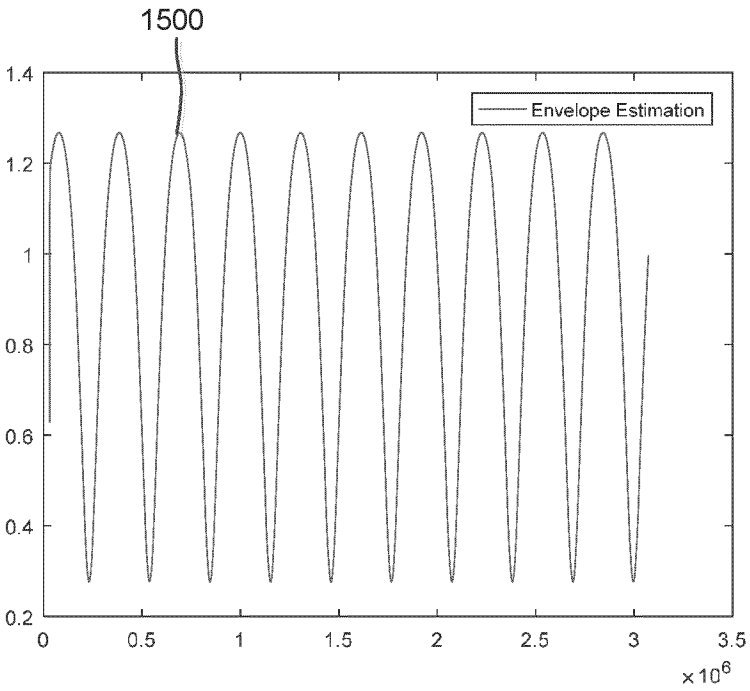
FIG. 15 is a graph illustrating the normalized envelope obtained using the estimated envelope of FIG. 14.

The envelope estimation circuit 945 estimates an envelope from the filtered tracking signal component 940 and normalizes the estimated envelope to obtain a tracking signal envelope 950, which is input into the signal correction circuit 930. To estimate the envelope of the filtered tracking signal component 940, the envelope estimation circuit 945 identifies a maximum value between two zero cross values of the filtered tracking signal component. This maximum value is called a current maximum value and may be classified in terms of a root mean square value, an absolute value, or another type of value. Several current maximum values make up the envelope. The envelope is shown in FIG. 14. The envelope estimation circuit 945 then normalizes the envelope to obtain a normalized envelope. The normalized envelope is shown in FIG. 15. In some embodiments, the normalization of the envelope may be termed as a calibration process.

Specifically, in the calibration process, the calibration value identified from the first portion 820 of FIG. 8 above is multiplied by an inverse of the envelope (e.g., the current maximum values) to obtain the normalized envelope. In other words, the normalized envelope may be obtained by dividing the calibration value with the estimated envelope. At low SPL, the normalized envelope may have a value of 1.0. As the SPL increases, the value of the normalized envelope also increases. The normalized envelope is the tracking signal envelope 950, which is then input into the signal correction circuit 930.

The signal correction circuit 930 thus receives two inputs—a first input of the filtered audio signal component 925 and a second input of the normalized envelope (e.g., the tracking signal envelope 950). The signal correction circuit 930 is configured to apply a Trapezoidal integration method to compensate for distortion in the filtered audio signal component 925 using the tracking signal envelope 950. Specifically, the signal correction circuit 930 may be configured to apply the Trapezoidal integration method for approximating the tracking signal envelope 950 and the filtered audio signal component 925 to obtain the compensated filtered audio signal component, which has been compensated for distortion. The Trapezoidal integration may be applied using the following formula:

$$\text{out}=\int dY_{envelope}*dY_{Audio}$$

where $dY_{envelope}$ is a differential of the tracking signal envelope 950;

$dY_{Audio}$ is a differential of the filtered audio signal component 925; and out=the compensated filtered audio signal component.

In terms of a MATLAB implementation, the Trapezoidal integration method may be implemented as follows:

$$\text{out}(n)=\text{out}(n-1)+dmdi$$

where dmdi=di*envelope(n−1)+di*dm/2;

di=audio(n)−audio(n−1);

dm=envelope(n)−envelope(n−1);

audio(n), audio (n−1) are signals obtained from the filtered audio signal component 925 at times n and n−1; and envelope(n), envelope(n−1) are signals obtained from the tracking signal envelope 950 at times n and n−1.

The Trapezoidal integration method alters the filtered audio signal component 925 using the tracking signal envelope 950 to compensate for the distortion in the filtered audio signal component 925. Thus, the signal correction circuit 930 adjusts (e.g., reduces) distortion in the filtered audio signal component 925. The output of the Trapezoidal integration method is a compensated microphone output signal 955. The compensated microphone output signal 955 is equivalent to the compensated microphone output signal 585 of FIG. 5 and the compensated microphone output signal 650 of FIG. 6.

Figure 10:
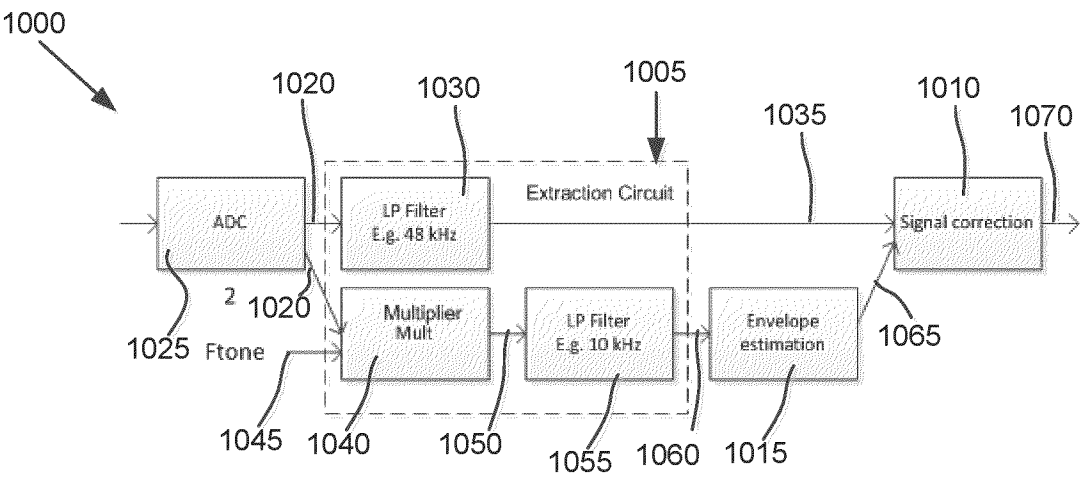
FIG. 10 is a second schematic showing separation of the audio signal component and the tracking signal component, estimation of the tracking signal envelope, and compensation of distortion in the audio signal component.

FIG. 10 is another example of a post compensation circuit 1000 having an extraction circuit 1005, a signal correction circuit 1010, and an envelope estimation circuit 1015. The extraction circuit 1005 receives a digital signal 1020 from ADC 1025. A low pass filter 1030 of the extraction circuit 1005 extracts the audio signal component from the digital signal 1020 to obtain a filtered audio signal component 1035. The low pass filter 1030 is similar to the low pass filter 920. The filtered audio signal component 1035 is input into the signal correction circuit 1010.

Additionally, the digital signal 1020 is input into a multiplier circuit 1040. The multiplier circuit 1040 multiplies the digital signal 1020 with input tracking signal 1045 to extract the tracking signal component from the digital signal 1020 to obtain a multiplied signal 1050. The input tracking signal 1045 is similar to the input tracking signal 505, 655. By multiplying the digital signal 1020 with the input tracking signal 1045, an amplitude of the tracking signal component in the digital signal 1020 may be modulated and the tracking signal component converted into a direct current signal. The multiplied signal 1050 is then input into a low pass filter 1055.

In some embodiments, instead of using the multiplier circuit 1040, a special ADC may be used. The special ADC may be configured with a low sampling frequency using a Nyquist algorithm. The output of the special ADC may be similar to the multiplied signal 1050, which may then be input into the low pass filter 1055.

The low pass filter 1055, in some embodiments, may be configured with a cutoff frequency of about ten kilo hertz (10 kHz), although other cutoff frequencies may be used in other embodiments. The multiplied signal 1050 is filtered through the low pass filter 1055. By filtering the multiplied signal 1050 through the low pass filter 1055, a filtered tracking signal component 1060 is obtained.

The filtered tracking signal component 1060 is then used to estimate an envelope in the envelope estimation circuit 1015. In contrast to the process described in FIG. 9 above for identifying the current maximum values using zero cross values for estimating the envelope, the current maximum values in FIG. 10 are automatically determined by virtue of passing the digital signal 1020 through the multiplier unit and the low pass filter 1055. After the envelope is estimated, the envelope is normalized, as described above, to obtain a tracking signal envelope 1065. The tracking signal envelope 1065 is then input into the signal correction circuit 1010, which is similar to the signal correction circuit 930. The signal correction circuit 1010 uses the tracking signal envelope 1065 (e.g., the normalized envelope) to compensate for distortion in the filtered audio signal component 1035 to obtain a compensated microphone output signal 1070.

Figure 11:
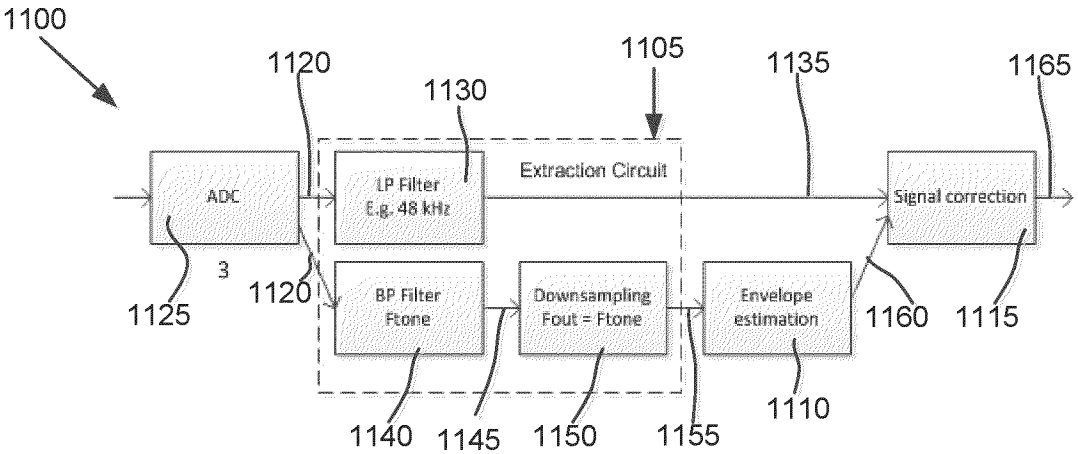
FIG. 11 is a third schematic showing separation of the audio signal component and the tracking signal component, estimation of the tracking signal envelope, and compensation of distortion in the audio signal component.

FIG. 11 is yet another example of a post compensation circuit 1100 having an extraction circuit 1105, an envelope estimation circuit 1110, and a signal correction circuit 1115. The extraction circuit 1105 receives a digital signal 1120 having an audio signal component and a tracking signal component from ADC 1125. The extraction circuit 1105 includes a low pass filter 1130 to extract the audio signal component from the digital signal 1120. The low pass filter 1130 is similar to the low pass filter 920. Filtered audio signal component 1035 is input into the signal correction circuit 1115.

The digital signal 1120 is also input into a bandpass filter 1140 of the extraction circuit 1105 to generate a filtered tracking signal component 1145. The bandpass filter 1140 may be configured with specific frequencies such that the bandpass filter allows the tracking signal component to pass through, while blocking the audio signal component in the digital signal 1120. The filtered tracking signal component 1145 is then down sampled in a down sampling circuit 1150 such that a sampling frequency of the filtered tracking signal component is similar to the frequency of the tracking signal component in the digital signal 1120. Down sampled tracking signal component 1155 is input into the envelope estimation circuit 1110.

The envelope estimation circuit 1110 is similar to the envelope estimation circuit 1015 of FIG. 10 above. Thus, the envelope estimation circuit 1110 estimates the envelope from the down sampled tracking signal component 1155 and normalizes the envelope to obtain a tracking signal envelope 1160. The tracking signal envelope 1160 is then input into the signal correction circuit 1115. The signal correction circuit 1115 utilizes the Trapezoidal method, similar to the signal correction circuit 930 and the signal correction circuit 1010, to obtain a compensated microphone output signal 1165.

FIG. 14 is a graph 1400 illustrating an example of a tracking signal component 1405 of a digital signal in which an envelope 1410 has been identified. The envelope 1410 corresponds to a plurality of current maximum values (e.g., tips of the tracking signal component 1405) found using each zero cross value of the tracking signal component 1405. In other embodiments, other mechanisms to identify the envelope 1410 may be used. For example, as discussed in FIG. 10, passing the digital signal 1020 through the multiplier circuit 1040 or the special ADC unit (not shown), and the low pass filter 1055 identifies the envelope 1410. Similarly, in FIG. 11, passing the digital signal 1120 through the bandpass filter 1140 and the down sampling circuit 1150 identifies the envelope 1410.

After estimating the envelope 1410, the envelope 1410 is normalized. As noted above, to normalize the envelope 1410, the tracking signal component 1405 is calibrated by dividing the calibration value by the current maximum values. A normalized envelope 1500 is shown in FIG. 15. Additionally, as discussed above, the envelope estimation circuit (e.g., the envelope estimation circuit 945, 1015, 1110) performs both the estimation of the envelope 1410, as well as normalization of the estimated envelope to obtain the tracking signal envelope 1500. In other embodiments, separate circuits to estimate and normalize the envelope to obtain the tracking signal envelope 1500 may be used.

Figure 16:
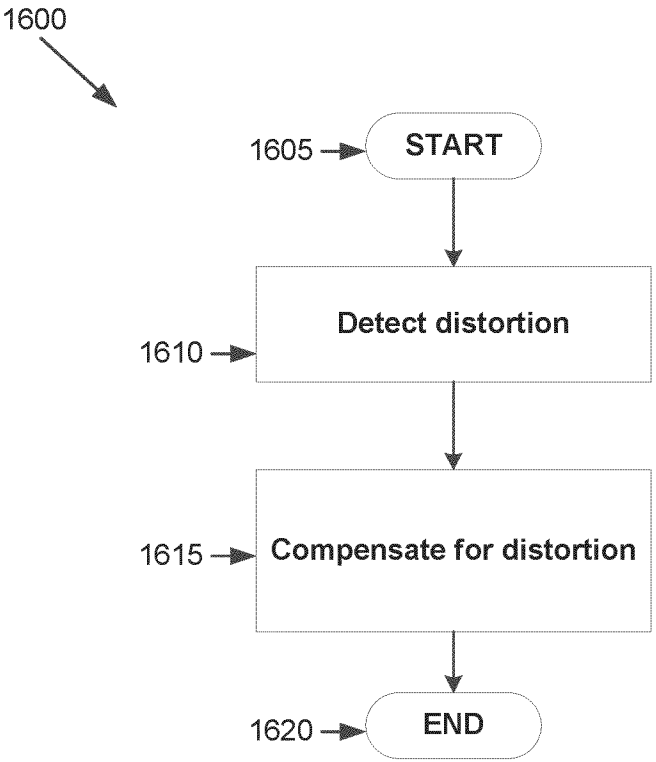
FIG. 16 is a flowchart outlining operations for compensating for distortion in the microphone assembly.

FIG. 16 shows an example flowchart outlining a process 1600 for compensating for distortion in a microphone signal that is output from a microphone assembly (e.g., the microphone assembly 100). Thus, after starting at operation 1605, the process 1600 first estimates distortion in the microphone signal at operation 1610. The operation 1610 is described in greater detail in FIG. 17 below. At operation 1615, distortion in the microphone signal is compensated. The operation 1615 is discussed in greater detail in FIG. 18 below. The process 1600 ends at operation 1620.

Figure 17:
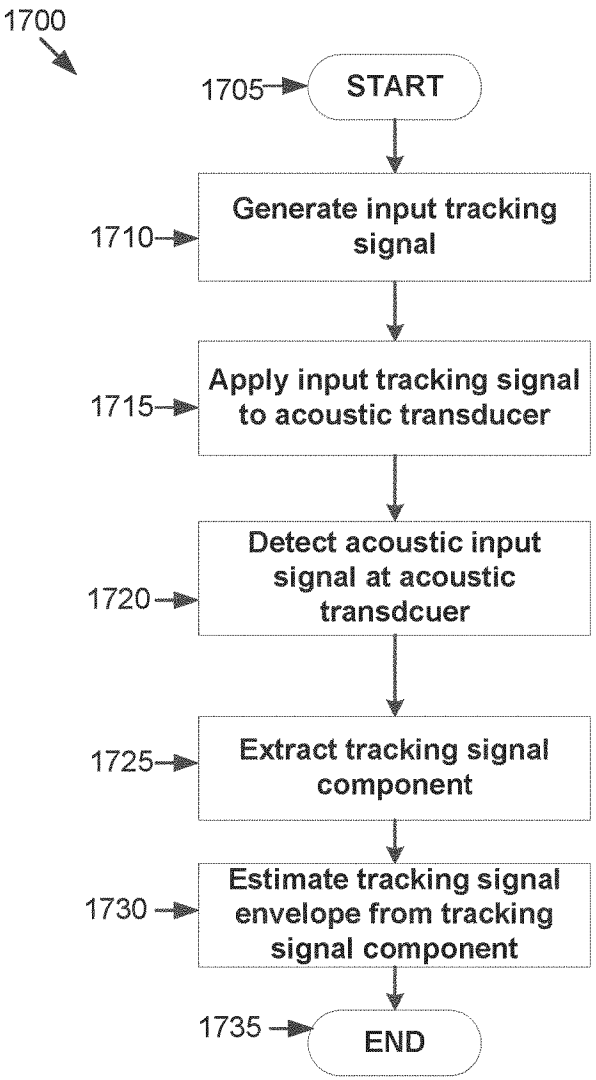
FIG. 17 is a flowchart outlining operations for estimating the tracking signal envelope.

FIG. 17 shows an example flowchart of a process 1700 outlining the operations for determining distortion in a microphone signal. After starting at operation 1705, an input tracking signal (e.g., the input tracking signal 505 in FIG. 5) is generated at operation 1710. As indicated above, the input tracking signal is a known signal, but with an amplitude within the linear operating region of the microphone assembly. In some embodiments, the input tracking signal is a ninety four decibels SPL (94 dB SPL) signal. The input tracking signal may be generated using a tracking signal generator or using other techniques (e.g., such as those described in FIG. 6). The input tracking signal is input to the transducer at operation 1715. In one embodiment, the input tracking signal is an electrical signal input to the transducer via the charge pump signal and in another embodiment the input tracking signal is an acoustic signal input to the transducer.

At operation 1720, an acoustic input signal is input to, or detected, by the acoustic transducer. The output signal of the acoustic transducer includes an audio signal component and a tracking signal component. Since the input tracking signal is a known signal, variations in the tracking signal component, and thus the distortion in the audio signal component may be determined.

As discussed above, the output signal is converted into a digital signal using an analog-to-digital converter. From the digital signal, the tracking signal component and the audio signal component are separated (e.g., using any of the mechanisms discussed in FIGS. 9-11 above) and an envelope (e.g., the envelope 1410) is estimated at operation 1725. Estimation of the envelope is discussed above in FIG. 14. The estimated envelope is then normalized at operation 1730 to obtain a tracking signal envelope (e.g., the tracking signal envelope 950, 1065, 1160). The process 1700 ends at operation 1735. Although the operations 1725 and 1730 have been described as part of the process 1700, those operations may be performed as part of FIG. 18 instead.

Figure 18:
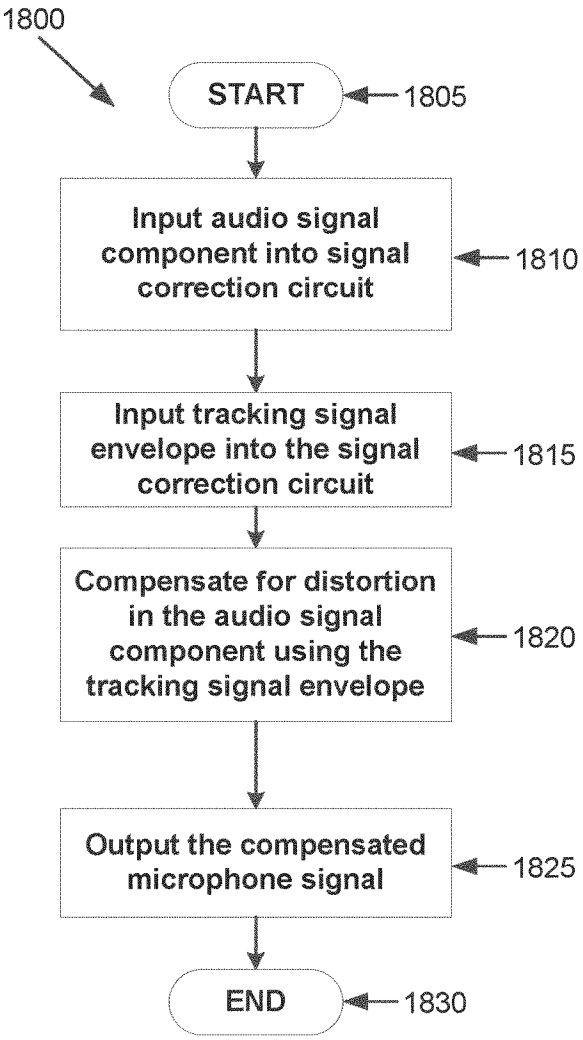
FIG. 18 is a flowchart outlining operations for compensating for distortion after estimating the tracking signal envelope.

FIG. 18 shows another flowchart of a process 1800 outlining the operations for compensating for distortion in the audio signal component of the digital signal. To compensate, the distortion is first estimated using the process 1700 of FIG. 17. After the distortion is estimated, the process of compensating for the distortion starts at operation 1805. At operation 1810, the audio signal component is extracted from the digital signal and the extracted audio signal component is input into a signal correction circuit. Additionally, at operation 1815, the signal correction circuit receives the tracking signal envelope from the operation 1730 of FIG. 17.

Using the tracking signal envelope, the signal correction circuit compensates for the distortion in the audio signal component at operation 1820. Specifically, the signal correction unit applies a Trapezoidal integration method, discussed above, to compensate for the distortion in the audio signal component. By compensating, the distortion in the audio signal component is reduced. A compensated microphone signal is output at operation 1825 and the process ends at operation 1830.

Figure 19:
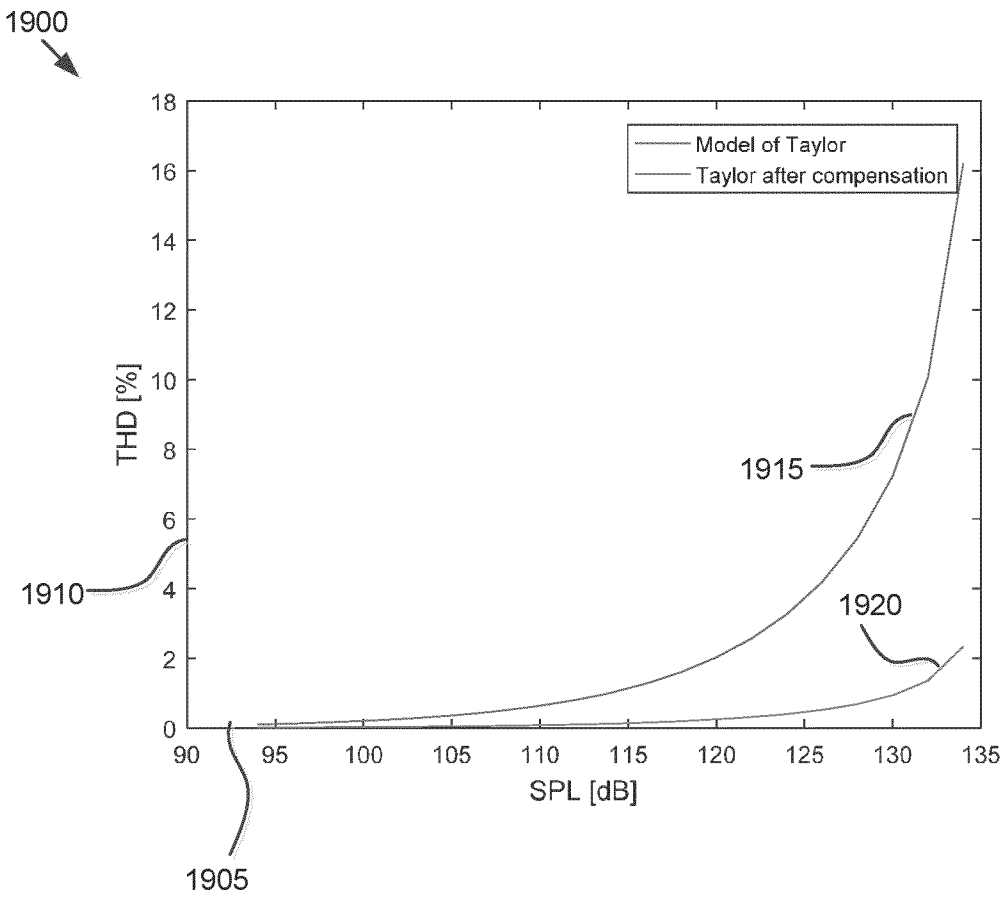
FIG. 19 is a graph of total harmonic distortion (THD) versus sound pressure level (SPL) of a modeled relationship before and after compensation.

FIG. 19 is a graph 1900 that shows reduction in total harmonic distortion in a microphone signal processed using the method described above. The graph plots SPL level in decibels on x-axis 1905 against a total harmonic distortion in percentage on y-axis 1910. The graph 1900 also shows a first plot 1915 of an unprocessed microphone signal, which shows that as the SPL level increases, the total harmonic distortion in the microphone signal represented by the first plot also increases. The graph 1900 additionally shows a second plot 1920 of a microphone signal that has been compensated. It can be seen from the graph 1900 that the second plot 1920 shows a much smaller increase in the total harmonic distortion with increasing SPL levels. In other words, by compensating for the distortion in a microphone signal, the total harmonic distortion in the microphone signal may be reduced from the levels shown in the first plot 1915 to the levels shown in the second plot 1920. Other types of distortion may also be reduced as a result of the processes described herein.

Thus, the system and method described herein advantageously reduces distortion in a microphone signal, thereby improving sound quality.

In accordance with some aspects of the present disclosure, an audio signal electrical circuit is disclosed. The audio signal electrical circuit includes an extraction circuit configured to receive a digital signal having an audio signal component and a tracking signal component and to extract the tracking signal component and the audio signal component from the digital signal, the audio signal component representative of an acoustic signal detected by an acoustic transducer. The audio signal electrical circuit also includes an envelope estimation circuit configured to estimate a tracking signal envelope from the tracking signal component and a signal correction circuit configured to reduce distortion in the audio signal component using the tracking signal envelope.

In accordance with other aspects of the present disclosure, a microphone assembly is disclosed. The microphone assembly includes an acoustic transducer and an audio signal electrical circuit configured to receive an output signal from the acoustic transducer. The output signal includes an audio signal component and a tracking signal component, and the audio signal component is representative of an acoustic signal detected by the acoustic transducer and the tracking signal component is based on an input tracking signal applied to the acoustic transducer. The audio signal electrical circuit includes an analog to digital converter configured to convert the output signal into a digital signal, an extraction circuit configured to separate the tracking signal component and the audio signal component from the digital signal, and an envelope estimation circuit configured to estimate a tracking signal envelope from the tracking signal component. The audio signal electrical circuit also includes a signal correction circuit configured to reduce distortion in the audio signal component using the tracking signal envelope.

In accordance with yet other aspects of the present disclosure, a method in an audio signal electrical circuit is disclosed. The method includes converting an amplified signal, by an analog to digital converter, to a digital signal. The digital signal includes an audio signal component representative of an acoustic signal and a tracking signal component based on an input tracking signal. The method also includes separating, by an extraction circuit, the audio signal component and the tracking signal component from the digital signal, estimating, by an envelope estimation circuit, a tracking signal envelope from the tracking signal component, and reducing, by a signal correction circuit, distortion in the audio signal component using the tracking signal envelope.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents. While various embodiments and figures are described as including particular components, it should be understood that modifications to the embodiments described herein can be made without departing from the scope of the present disclosure. For example, in various implementations, an embodiment described as including a single component could include multiple components in place of the single component, or multiple components could be replaced with a single component. Similarly, embodiments described as including a particular component may be modified to replace that component with an alternative component or group of components designed to perform a similar function. In some embodiments, method steps described herein could be performed in a different order, additional steps than are shown may be performed, or one or more steps may be omitted.

What is claimed is:

1. An audio signal electrical circuit comprising:

an extraction circuit configured to receive a digital signal having an audio signal component and a tracking signal component and to extract the tracking signal component and the audio signal component from the digital signal, the audio signal component representative of an acoustic signal detected by an acoustic transducer;

an envelope estimation circuit configured to estimate a tracking signal envelope from the tracking signal component; and a signal correction circuit configured to reduce distortion in the audio signal component using the tracking signal envelope.

2. The audio signal electrical circuit of claim 1 in combination with an acoustic transducer and further comprising an analog to digital (A/D) converter configured to receive an analog signal from the acoustic transducer, and convert the analog signal to the digital signal, wherein the acoustic transducer is a microelectromechanical (MEMS) sensor and the analog signal includes an analog output signal from the acoustic transducer and an analog tracking signal.

3. The audio signal electrical circuit of claim 2, further comprising:

an amplifier configured to amplify the analog signal before the analog signal is applied to the A/D converter.

4. The audio signal electrical circuit of claim 1, wherein the extraction circuit comprises a low pass filter configured to extract the audio signal component from the digital signal.

5. The audio signal electrical circuit of claim 4, wherein the extraction circuit comprises a peak filter configured to extract the tracking signal component from the digital signal.

6. The audio signal electrical circuit of claim 4, wherein the extraction circuit comprises:

a multiplier configured to multiply an input tracking signal with the digital signal to obtain a multiplied signal, the tracking signal component based on the input tracking signal.

7. The audio signal electrical circuit of claim 4, wherein the extraction circuit comprises:

a bandpass filter configured to extract the tracking signal component from the digital signal; and a down sampling circuit configured to down sample the tracking signal component before estimation of the tracking signal envelope.

8. The audio signal electrical circuit of claim 1, wherein the signal correction circuit is configured to compute an integral of a product obtained by multiplying a differential of the audio signal component and a differential of the tracking signal envelope.

9. A microphone assembly comprising:

an acoustic transducer; and an audio signal electrical circuit configured to receive an output signal from the acoustic transducer, wherein the output signal includes an audio signal component and a tracking signal component, wherein the audio signal component is representative of an acoustic signal detected by the acoustic transducer and the tracking signal component is based on an input tracking signal applied to the acoustic transducer; and wherein the audio signal electrical circuit comprises:

an analog to digital converter configured to convert the output signal into a digital signal;

an extraction circuit configured to separate the tracking signal component and the audio signal component from the digital signal;

an envelope estimation circuit configured to estimate a tracking signal envelope from the tracking signal component; and a signal correction circuit configured to reduce distortion in the audio signal component using the tracking signal envelope.

10. The microphone assembly of claim 9, further comprising a microphone housing configured to enclose and support the acoustic transducer and the audio signal electrical circuit, the housing including a physical interface.

11. The microphone assembly of claim 10, wherein the microphone housing includes a sound port connecting an interior and exterior of the microphone housing, the microphone housing including a base and a cover coupled to the base, the base having a surface mount electrical interface.

12. The microphone assembly of claim 11, wherein the acoustic transducer comprises a microelectromechanical (MEMS) sensor.

13. The microphone assembly of claim 9, wherein the acoustic transducer comprises a microelectromechanical (MEMS) capacitive sensor, the microphone assembly further comprising a charge pump configured to apply a bias voltage to the MEMS capacitive sensor, wherein the input tracking signal is applied to the MEMS capacitive sensor via the bias voltage.

14. The microphone assembly of claim 13, wherein the input tracking signal has a frequency that is higher than a frequency of the audio signal component.

15. The microphone assembly of claim 13, wherein the input tracking signal is an ultrasonic signal.

16. The microphone assembly of claim 9, further comprising an input tracking signal generator coupled to a second acoustic transducer proximate the acoustic transducer, wherein the input tracking signal is an acoustic signal detectable by the acoustic transducer.

17. A method in an audio signal electrical circuit, the method comprising:

converting an amplified signal, by an analog to digital converter, to a digital signal, wherein the digital signal includes an audio signal component representative of an acoustic signal and a tracking signal component based on an input tracking signal;

separating, by an extraction circuit, the audio signal component and the tracking signal component from the digital signal;

estimating, by an envelope estimation circuit, a tracking signal envelope from the tracking signal component; and reducing, by a signal correction circuit, distortion in the audio signal component using the tracking signal envelope.

18. The method of claim 17, further comprising:

applying the input tracking signal to an acoustic transducer;

detecting the acoustic signal with the acoustic transducer;

outputting an output signal from the acoustic transducer; and generating the amplified signal by amplifying the output signal.

19. The method of claim 17, wherein separating the audio signal component comprises extracting the audio signal component from the digital signal using a low pass filter.

20. The method of claim 19, wherein separating the tracking signal component from the digital signal comprises one of filtering the digital signal with a peak filter, or multiplying the digital signal with the input tracking signal, or filtering the digital signal with a band pass filter and down sampling the band pass filtered signal.

* * * * *